US009750340B2

(12) United States Patent
Turner et al.

(10) Patent No.: US 9,750,340 B2
(45) Date of Patent: Sep. 5, 2017

(54) BANQUET TABLE

(71) Applicant: Ameriwood Industries, Inc., Wright City, MO (US)

(72) Inventors: Dennis M Turner, Mooresville, IN (US); Andrew B Mendenhall, Mooresville, IN (US); Paul T Zink, Fishers, IN (US)

(73) Assignee: Dorel Home Furnishings, Inc., Wright City, MO (US)

( * ) Notice: Subject to any disclaimer, the term of this patent is extended or adjusted under 35 U.S.C. 154(b) by 0 days.

(21) Appl. No.: 15/041,242

(22) Filed: Feb. 11, 2016

(65) Prior Publication Data

US 2016/0227918 A1 Aug. 11, 2016

Related U.S. Application Data

(60) Provisional application No. 62/114,947, filed on Feb. 11, 2015.

(51) Int. Cl.

| | |
|---|---|
| ***A47B 3/00*** | (2006.01) |
| ***A47B 13/08*** | (2006.01) |
| ***A47B 3/087*** | (2006.01) |
| *A47B 3/091* | (2006.01) |

(52) U.S. Cl.

CPC ..... *A47B 13/08* (2013.01); *A47B 3/087* (2013.01); *A47B 3/0912* (2013.01)

(58) Field of Classification Search

CPC ..... A47B 3/08; A47B 3/002; A47B 3/091; A47B 3/0809; A47B 3/0815; A47B 3/00; A47B 2003/025; A47B 13/08; A47B 77/022

USPC .... 108/132, 129, 27, 115, 131, 133, 157.18; 248/188.6

See application file for complete search history.

(56) References Cited

U.S. PATENT DOCUMENTS

| | | | | | |
|---|---|---|---|---|---|
| 2,298,578 | A | * | 10/1942 | Madsen | A47B 13/083 108/27 |
| D142,211 | S | * | 8/1945 | Glukes | 108/157.18 |
| 2,628,141 | A | * | 2/1953 | Scheuer | A47F 5/0043 108/101 |
| 2,876,053 | A | * | 3/1959 | Eves | E06B 3/72 108/27 |
| 2,940,805 | A | * | 6/1960 | Nordmark | A47B 13/083 108/27 |
| 4,858,413 | A | * | 8/1989 | Grushka | A47B 95/043 108/27 |
| 5,018,628 | A | * | 5/1991 | Schenck | A47B 96/18 108/27 |
| 5,479,864 | A | * | 1/1996 | Kemp | A47B 13/083 108/27 |
| 5,497,597 | A | * | 3/1996 | Elzenbeck | A47B 13/083 108/159.11 |
| 5,697,686 | A | | 12/1997 | Miller et al. | |
| 5,947,037 | A | * | 9/1999 | Hornberger | A47B 13/02 108/115 |

(Continued)

*Primary Examiner* — Jose V Chen

(74) *Attorney, Agent, or Firm* — Barnes & Thornburg LLP

(57) ABSTRACT

A table in accordance with the present disclosure includes a table top and a table top elevator. The table top elevator may include a first leg unit and a second leg unit. Each leg unit may be mounted for movement relative to the table top from a closed position alongside the table top to an opened position extending away from the table top.

22 Claims, 4 Drawing Sheets

(56) References Cited

U.S. PATENT DOCUMENTS 5,983,807 A * 11/1999 Tarnay ..... A47B 3/0912 108/131
6,123,031 A * 9/2000 Hayman-Chaffey .. A47B 13/08 108/157.1
6,837,171 B1 * 1/2005 Clark ..... A47B 13/086 108/131
7,007,314 B2 3/2006 Courouzos
7,178,471 B2 * 2/2007 Strong ..... A47B 3/087 108/129
7,278,361 B2 * 10/2007 Zhurong ..... A47B 3/0912 108/132
7,299,754 B2 * 11/2007 Stanford ..... A47B 3/091 108/129
7,475,641 B2 * 1/2009 Jin ..... A47B 3/087 108/132
7,905,185 B2 * 3/2011 Peery ..... A47B 3/0912 108/132
8,181,579 B2 * 5/2012 Leng ..... A47B 13/003 108/161
8,240,109 B2 8/2012 Cusson et al.
8,534,029 B2 * 9/2013 Leng ..... A47B 13/08 52/783.1
8,534,752 B2 9/2013 Martin et al.
8,561,552 B2 * 10/2013 Chang ..... A47B 3/087 108/132
8,584,602 B2 11/2013 Isgro
8,677,912 B1 * 3/2014 Tsai ..... F16C 11/10 108/132
8,689,705 B2 4/2014 Martin et al.
8,925,468 B2 1/2015 Polidoros
2004/0025760 A1 * 2/2004 Avrahami ..... A47B 3/0912 108/132
2004/0244656 A1 * 12/2004 Shenghao ..... A47B 3/0912 108/132
2005/0223951 A1 * 10/2005 Leng ..... A47B 13/08 108/27
2013/0312642 A1 11/2013 Martin et al.
2014/0352579 A1 12/2014 Haansbaek et al.

* cited by examiner

BANQUET TABLE

CROSS REFERENCE TO RELATED APPLICATIONS

This application claims priority under 35 U.S.C. §119(e) to U.S. Provisional Patent Application No. 62/114,947, filed Feb. 11, 2015, which is expressly incorporated by reference herein.

BACKGROUND

The present disclosure relates to a table, and particularly to a folding table. More particularly, the present disclosure relates to a center-fold banquet table having a plastic table top.

SUMMARY

A table in accordance with the present disclosure includes a table top and a table top elevator. The table top elevator may include a first leg unit and a second leg unit. Each leg unit may be mounted for movement relative to the table top from a closed position alongside the table top to an opened position extending away from the table top.

In illustrative embodiments, the table top may include a first section and a second section. A hinge unit may connect the first section of the table top to the second section and be configured to allow rotation of the first section of the table top relative to the second section between an expanded-use position and a collapsed-storage position. The first leg unit may be coupled to the first section of the table top and the second leg unit may be coupled to the second section of the table top.

In illustrative embodiments, each table top section may include a panel and a frame. The frame may include two spaced apart and parallel frame rails coupled to the hinge unit and one of the first or second leg units. The frame rails may be formed to include means for engaging the table top panels to hold the table top panels to the table top elevator so that the panels form a planar top surface of the table top in the expanded-use position during use of the table. The panels may slide relative to the frame rails and be exchanged with other panels to alter a use of the table as desired by a user. The panels may be formed to include various features in a top side and an under side to allow the panels to be used in multiple orientations and multiple purposes.

In illustrative embodiments, each panel may include a body and a panel retainer coupled to the body. At least one of the frame rails may include a retainer slot that receives the panel retainer so that a corresponding table top panel is engaged and is maintained in position with respect to the frame rail at the selection of a user. The frame rails may be extruded.

In illustrative embodiments, the panels may be extruded. In some embodiments, each panel may include a top side, an under side spaced apart from the top side, and a plurality of lattice members extending between the top side and under side to couple the top side to the under side.

Additional features of the present disclosure will become apparent to those skilled in the art upon consideration of illustrative embodiments exemplifying the best mode of carrying out the disclosure as presently perceived.

BRIEF DESCRIPTION OF THE DRAWINGS

The detailed description particularly refers to the accompanying figures in which.

DETAILED DESCRIPTION

Figure 1:
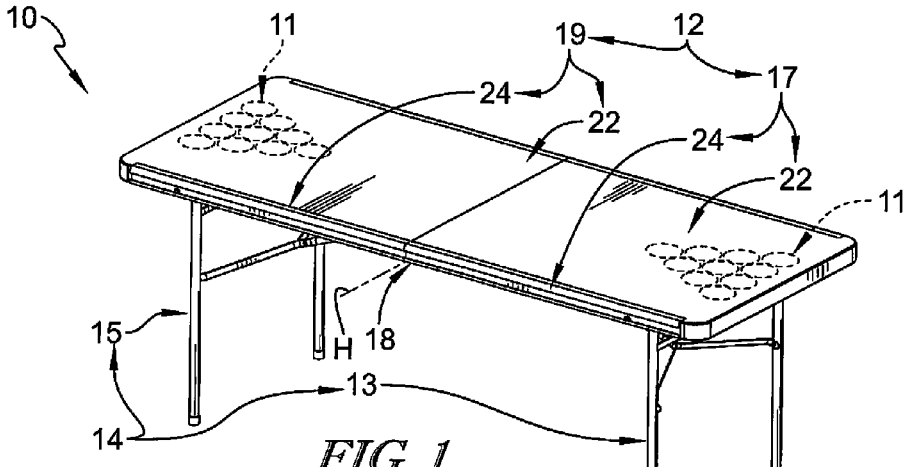
FIG. 1 is a top perspective view of a folding table in accordance with the present disclosure showing that the folding table includes a table top having a right-side section and a left-side section connected to the right-side section by a hinge unit and a table top elevator configured to support the table top above aground level and suggesting that panels of the table top are formed with various features and are configured to be exchanged with other panels at the selection of a user as suggested in FIG. 2.
Figure 4:
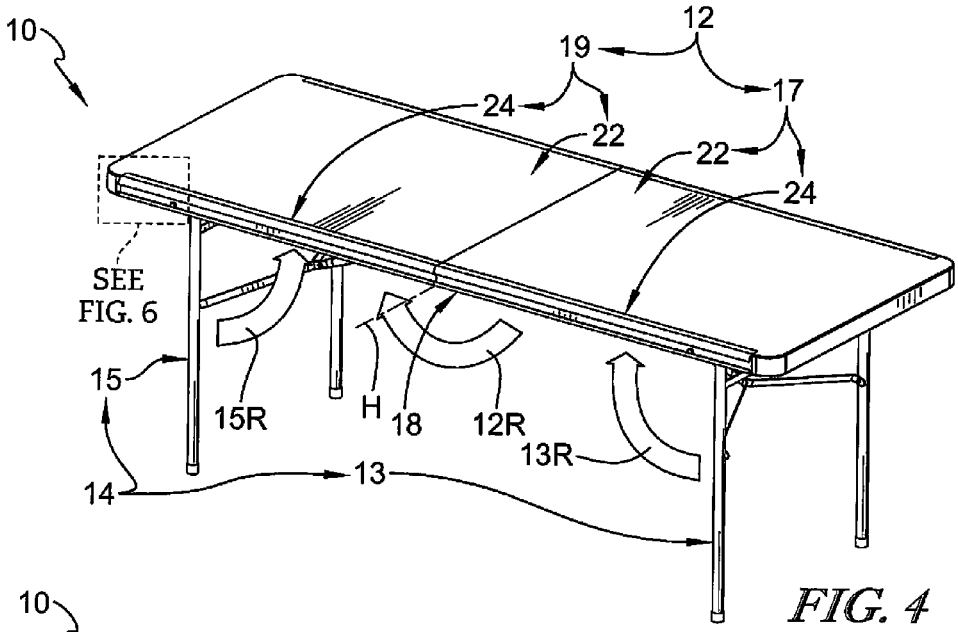
FIG. 4 is a view similar to FIG. 1 suggesting that the hinge unit is configured to support the right-side section for pivotable movement about an axis relative to the left-side section from an expanded-use position, as shown in FIG. 1, to a collapsed-storage position, as shown in FIG. 5, and that the right-side and left-side leg units are movable from an opened position extending away from the table top to a closed position extending along the table top.
Figure 5:
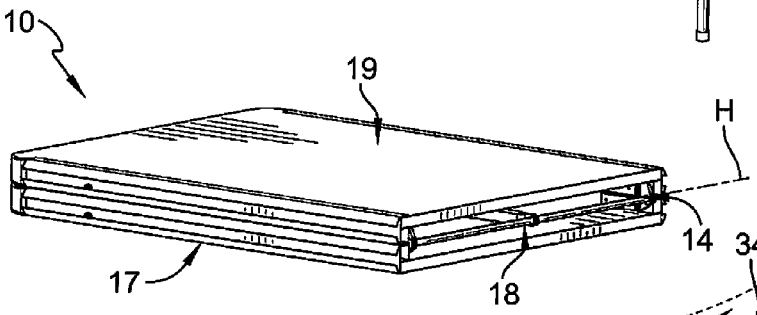
FIG. 5 is a top perspective view of the folding table of FIG. 1 showing the folding table in the collapsed-storage position and suggesting that the table top elevator is stored between the panels of the table top when the folding table is in the collapsed-storage position.

A folding table 10 in accordance with the present disclosure is shown in FIG. 1. Folding table 10 includes a table top 12 and a table top elevator 14 coupled to table top 12 for supporting table top 12 above a ground level. Table top 12 includes a right-side section 17 and a left-side section 19 coupled to right-side section 17 by a hinge unit 18 for rotation about a hinge axis H between an expanded-use position, shown in FIG. 1, and a collapsed-storage position, shown in FIG. 5, where right-side section 17 and left-side section 19 are folded toward one another about hinge axis H as suggested by arrow 12R in FIG. 4.

Right-side section 17 and left-side section 19 of table top 12 each include a panel 22 for supporting items placed on table top 12 and a frame 24 for supporting panels 22 on table top elevator 14 as shown in FIG. 1. In the illustrative embodiment, panels 22 can be exchanged with other panels 22 for use with frame 24 to form table top 12 as suggested in FIG. 2. In one example, panels 22 may include features 11, shown in phantom in FIG. 1, formed in panels 22 to adapt table 10 to an intended use of a user of table 10. Panels 22 having features 11 can be exchange for panels 22 which do not include features 11 or include other features as desired by a user of table 10 as suggested by arrow 221 in FIG. 2.

Figure 2:
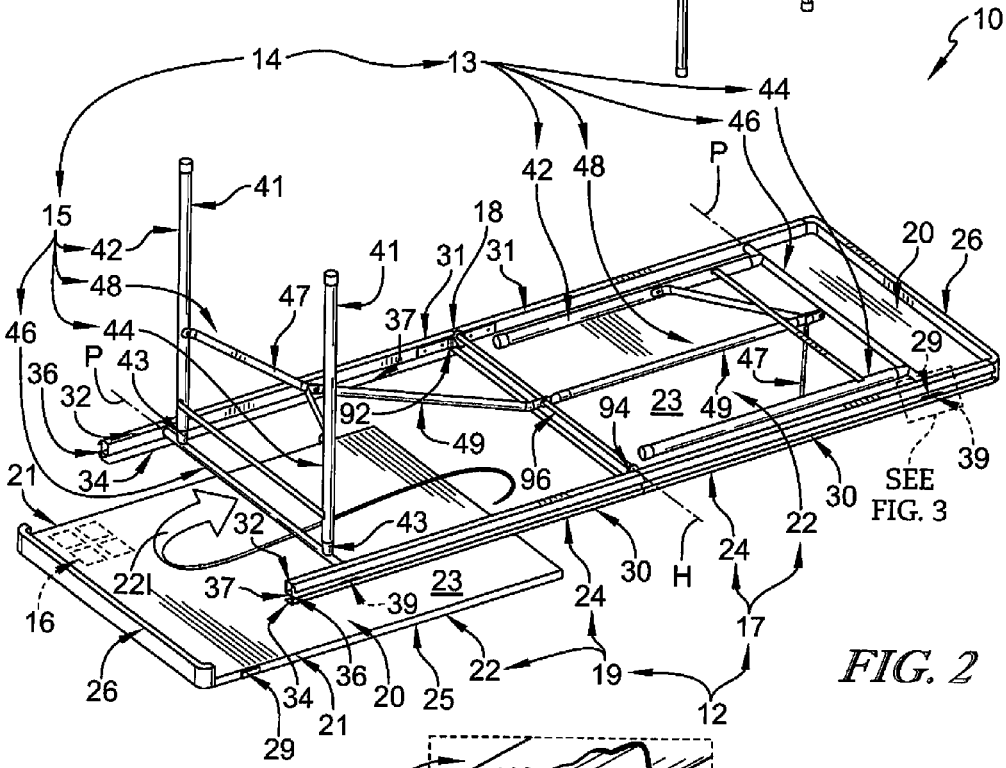
FIG. 2 is a bottom perspective view of the folding table of FIG. 1 showing that each table top section includes a frame and a panel that slides into engagement with the frame to form the table top section and that the table top elevator includes a right-side leg unit the right-side section of the table top and a left-side leg unit to the left-side section.

Each panel 22 includes a body 20 and an end cap 26 coupled to body 20 as shown in FIG. 2. Body 20 includes an under side 23 and an opposing top side 25. Body 20 of panel 22 further includes lateral edges 21 defining at least a portion of a perimeter of body 20. In some embodiments, panels 22 are formed by a blow-molding process. In some examples, weld cones 16, illustratively shown as squares in phantom in FIG. 2, are formed into underside 23 and optionally engaged with top side 25 of each panel 22 during the blow-molding process.

Frame 24 includes a first frame rail 30 and a second frame rail 31 spaced apart from first frame rail 30 and parallel to first frame rail 30 as shown in FIG. 2. First and second frame rails 30, 31 each include a frame tube 32, an upper wall 34 spaced apart from frame tube 32, and an outer wall 36 connecting frame tube 32 with upper wall 34. Frame tube 32 and upper wall 34 at least partially define a panel-receiving slot 37 (sometimes called a track 37) configured to receive lateral edges 21 of panels 22 and allow panels 22 to slide relative to frame 24 as suggested by arrow 221. In the illustrative embodiment, frame tube 32 is rectangular in cross-section. However, frame tube 32 may have different shaped cross-sections as shown, for example, in FIGS. 8-11. In some examples, first and second frame rails 30, 31 are formed by extrusion processes as unitary structures.

Figure 3:
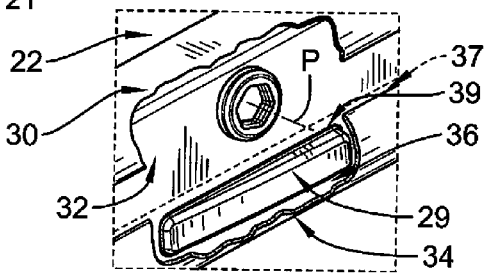
FIG. 3 is an enlarged view of the right-side section of the table top of FIG. 2 showing a panel retainer of the panel engaged with a retainer slot of the frame to hold the panel in the frame at the selection of a user.

Panels 22 each further include a panel retainer 29 (sometimes called a bump 29) coupled to at least one of lateral edges 21 as shown in FIGS. 2 and 3. Panel retainers 29 are configured to be received in a retainer slot 39 formed through outer wall 36 of first and second frame rails 30, 31 to maintain engagement of panel 22 and frame 24. End cap 26 is sized and configured to cover a distal end of first and second frame rails 30, 31. A user may disengage panels 22 from frames 24 by depressing panel retainer 29 inward of outer wall 36 and sliding panel 22 out of panel-receiving slots 37.

In some embodiments, panels 22 are configured to be received in the frame 24 with either top side 25 or under side 23 facing upwards. In some examples, panels 22 include various features in top side 25, such as features 11 shown in FIG. 1, and other different features on under side 23 to allow panels 22 to be used in multiple orientations and for multiple purposes. In some examples, a panel 22 includes a top side 25 which is substantially planar and an under side 23 having features formed therein which alter a use of table 10. A user inserts the panel 22 into the frame 24 with either planar top side 25 or under side 23 with formed features facing upward depending on the desired use of table 10.

Table top elevator 14 includes a right-side leg unit 13 coupled to right-side section 17 of table top 12 and a left-side leg unit 15 coupled to left-side section 19 as shown in FIG. 2. Right-side leg unit 13 and left-side leg unit 15 each include a first leg 42 and a second leg 44. In some embodiments, first leg 42 and second leg 44 are formed from metal tubes. First leg 42 and second leg 44 each include a lower end 41 and an upper end 43. Right-side leg unit 13 and left-side leg unit 15 each further include a pivot bar 46 coupled between first and second frame rails 30, 31 and pivotable about pivot axes P. Upper ends 43 of first and second legs 42, 44 are coupled to pivot bar 46 for rotation about pivot axis P and moveable between an opened position extending away from table top 12 and a closed position extending along table top 12 as suggested by arrows 13R, 15R in FIG. 4.

Hinge unit 18 includes a first hinge 92 coupled between right-side and left-side sections 17, 19, a second hinge 94 coupled between right-side and left-side sections 17, 19, and a cross bar 96 coupled between first and second hinges 92, 94 to allow pivoting movement of right-side and left-side sections 17, 19 about hinge axis H as shown in FIG. 2. Right-side leg unit 13 and left-side leg unit 15 each further include a support-mover linkage 48 for guiding motion of first and second legs 42, 44. Support-mover linkages 48 each include first linkage bars 47 coupled first and second legs 42, 44 and a second linkage bar 49 coupled between first linkage bars 47 and cross bar 96 of hinge unit 18. In some examples, panels 22 include one or more leg receivers coupled to under side 23 to engage right-side and left-side leg units 13, 15 to hold right-side and left-side leg units 13, 15 in the closed position at the selection of a user.

First linkage bars 47 are pivotable relative to first and second legs 42, 44, and second linkage bar 49 is pivotable with respect to first linkage bars 47 and cross bar 96 as shown in FIG. 2. In some embodiments, a sleeve or collar is coupled to second linkage bar 49 to slide along second linkage bar 49 and is movable between a locked position covering a joint between first and second linkage bars 47, 49 to hold right-side and left-side leg units 13, 15 in the opened position and an unlocked position away from the joint between first and second linkage bars 47, 49 to allow pivoting movement of right-side and left-side leg units 13, 15.

Figure 6:
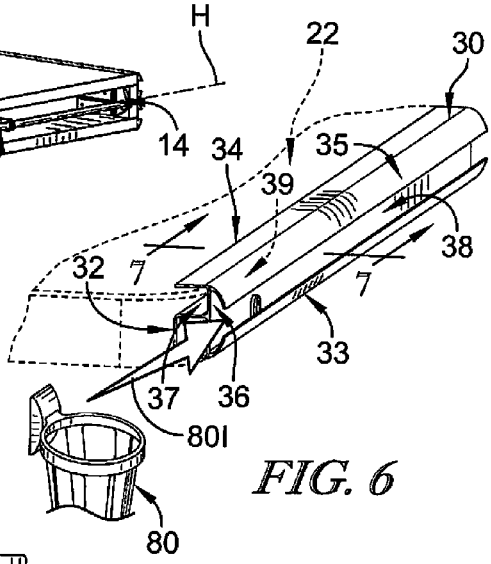
FIG. 6 is an enlarged view of the left-side frame of FIG. 4 showing a first embodiment of a frame rail of the frame having a frame tube, an upper wall spaced apart from the frame tube, and an outer wall connecting the upper wall to the frame tube to form a panel-receiving slot for engaging the panel of the table top to position the panel relative to the frame and suggesting that an accessory slot is formed on an exterior of the frame rail to allow attachment of accessories to the table top.

In the illustrative embodiment, frame rails 30, 31 each further include a first wall 33 extending outward and upward from frame tube 32 and a second wall 35 extending outward and downward from outer wall 36 as represented by frame rail 30 shown in FIG. 6. First and second walls 33, 35 at least partially define an accessory slot 38 configured to receive and hold accessories 80, as suggested by arrow 801 in FIG. 6, on table 10. In some examples, accessory 80 is a cup holder. However, other accessories are contemplated with this disclosure. Although first and second walls 33, 35 are shown as being arcuate, other shapes are possible.

Figure 7:
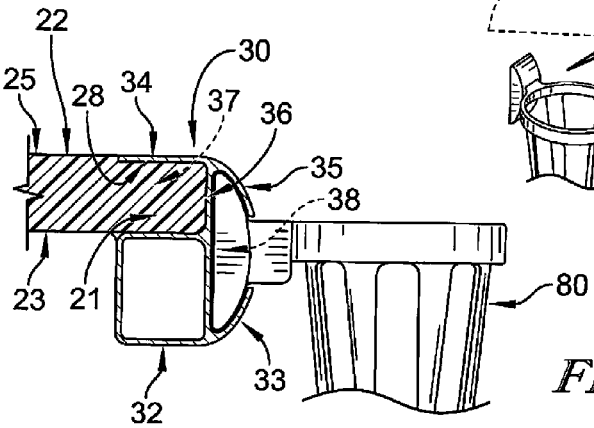
FIG. 7 is a sectional view taken along line 7-7 in FIG. 6 showing a lateral edge of the panel received in the panel-receiving slot between the upper wall and frame tube and suggesting that a recess is formed in the panel along the lateral edge to allow the upper wall of the frame rail to be flush with a top side of the panel.

Lateral edges 21 of panels 22 are received in panel-receiving slot 37, and trapped between frame tube 32 and upper wall 34, when panels 22 are inserted into frame 24 as suggested in FIG. 7. In the illustrative embodiment, a recess 28 is formed in top surface 25 of panel 22 and extends along lateral edge 21. Upper wall 34 is positioned within recess 28 when panel 22 is engaged with frame 24 such that upper wall 34 is planar or flush with top surface 25.

Figure 8:
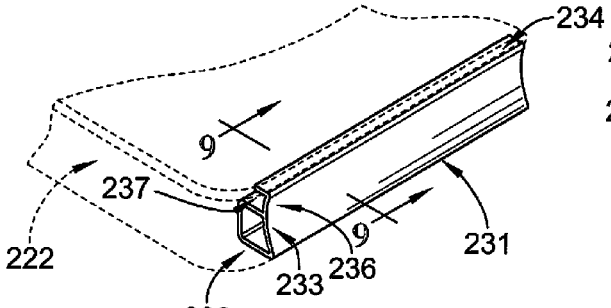
FIG. 8 is a perspective view of a second embodiment of a frame rail having a frame tube with a concave outer portion, an upper wall spaced apart from the frame tube, and a concave outer wall connecting the upper wall to the frame tube to form a panel-receiving slot for engaging a table top panel.
Figure 9:
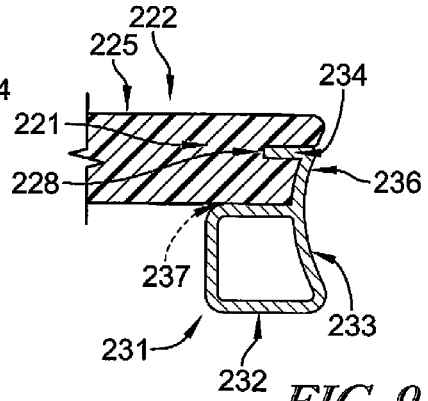
FIG. 9 is a sectional view taken along line 9-9 in FIG. 8 showing a lateral edge of the panel received in the panel-receiving slot between the upper wall and frame tube and suggesting that a recess is formed in the panel along the lateral edge to receive the upper wall and allow the panel and frame rail to cooperate to define a continuous concave edge profile along the table top.

In another illustrative embodiment, a frame rail 231 includes a frame tube 232, an upper wall 234 spaced apart from frame tube 232, and an outer wall 236 connecting frame tube 232 with upper wall 234 as shown in FIGS. 8 and 9. Frame tube 232 and upper wall 234 at least partially define a panel-receiving slot 237 configured to receive a lateral edge 221 of a panel 222. In the illustrative embodiment, frame tube 232 includes a concave portion 233 and outer wall 436 is formed to match a concave profile of portion 233. A recess 228 is formed in lateral edge 221 and extends along panel 222. Upper wall 234 is positioned within recess 228 when panel 222 is engaged with frame rail 231 to allow panel 222 and frame rail 231 to cooperate to define a continuous concave edge profile along a table using frame rail 231 and panel 222. In some examples, frame rail 231 is formed by an extrusion process as a unitary structure.

Figure 10:
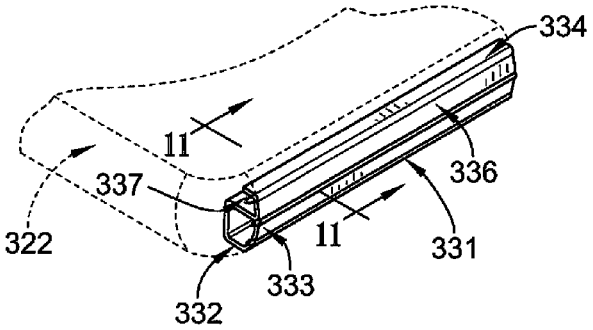
FIG. 10 is a perspective view of a third embodiment of a frame rail having a frame tube with a convex outer portion, an upper wall spaced apart from the frame tube, and a convex outer wall connecting the upper wall to the frame tube to form a panel-receiving slot for engaging a table top panel.
Figure 11:
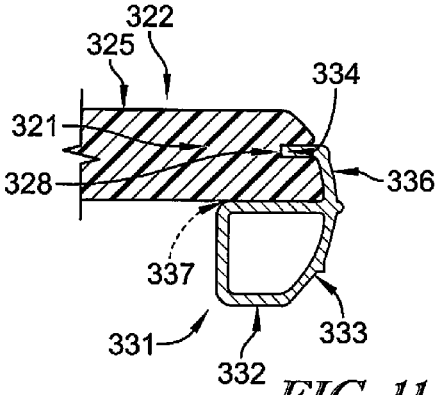
FIG. 11 is a sectional view taken along line 11-11 in FIG. 10 showing a lateral edge of the panel received in the panel-receiving slot between the upper wall and frame tube and suggesting that a recess is formed in the panel along the lateral edge to receive the upper wall and allow the panel and frame rail to cooperate to define a continuous convex edge profile along the table top.

In another illustrative embodiment, a frame rail 331 includes a frame tube 332, an upper wall 334 spaced apart from frame tube 332, and an outer wall 336 connecting frame tube 332 with upper wall 334 as shown in FIGS. 10 and 11. Frame tube 332 and upper wall 334 at least partially define a panel-receiving slot 337 configured to receive a lateral edge 321 of a panel 322. In the illustrative embodiment, frame tube 332 includes a convex portion 333 and outer wall 336 is formed to match a convex profile of portion 333. A recess 328 is formed in lateral edge 321 and extends along panel 322. Upper wall 334 is positioned within recess 328 when panel 322 is engaged with frame rail 331 to allow panel 322 and frame rail 331 to cooperate to define a continuous convex edge profile along a table using frame rail 331 and panel 322. In some examples, frame rail 331 is formed by an extrusion process as a unitary structure.

Figure 12:
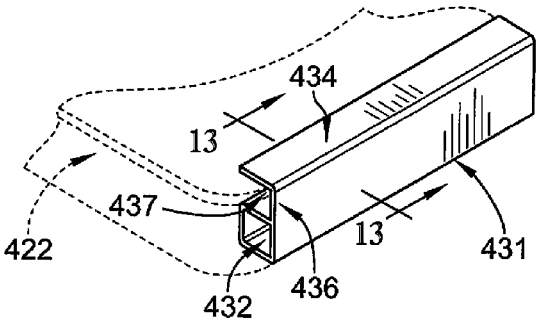
FIG. 12 is a perspective view of a fourth embodiment of a frame rail having a frame tube, an upper wall spaced apart from the frame tube, an outer wall connecting the upper wall to the frame tube to form a panel-receiving slot for engaging a table top panel.
Figure 13:
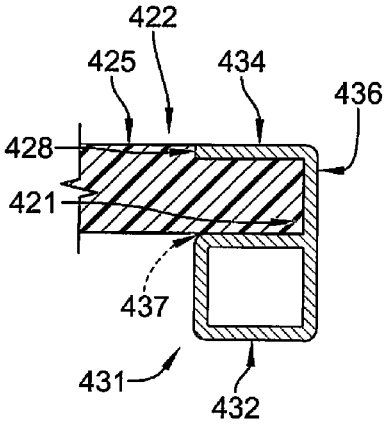
FIG. 13 is a sectional view taken along line 13-13 in FIG. 12 showing a lateral edge of the panel received in the panel-receiving slot between the upper wall and frame tube and suggesting that a recess is formed in the panel along the lateral edge to allow the upper wall of the frame rail to be flush with a top side of the panel.

In another illustrative embodiment, a frame rail 431 includes a frame tube 432, an upper wall 434 spaced apart from frame tube 432, and an outer wall 436 connecting frame tube 432 with upper wall 434 as shown in FIGS. 12 and 13. Frame tube 432 and upper wall 434 at least partially define a panel-receiving slot 437 configured to receive a lateral edge 421 of a panel 422. In the illustrative embodiment, frame tube 432 is square in cross-section. A recess 428 is formed in a top surface 425 of panel 422 and extends along lateral edge 421. Upper wall 434 is positioned within recess 428 when panel 422 is engaged with frame rail 431 such that upper wall 434 is planar or flush with top surface 425. In some examples, frame rail 431 is formed by an extrusion process as a unitary structure.

Figure 14:
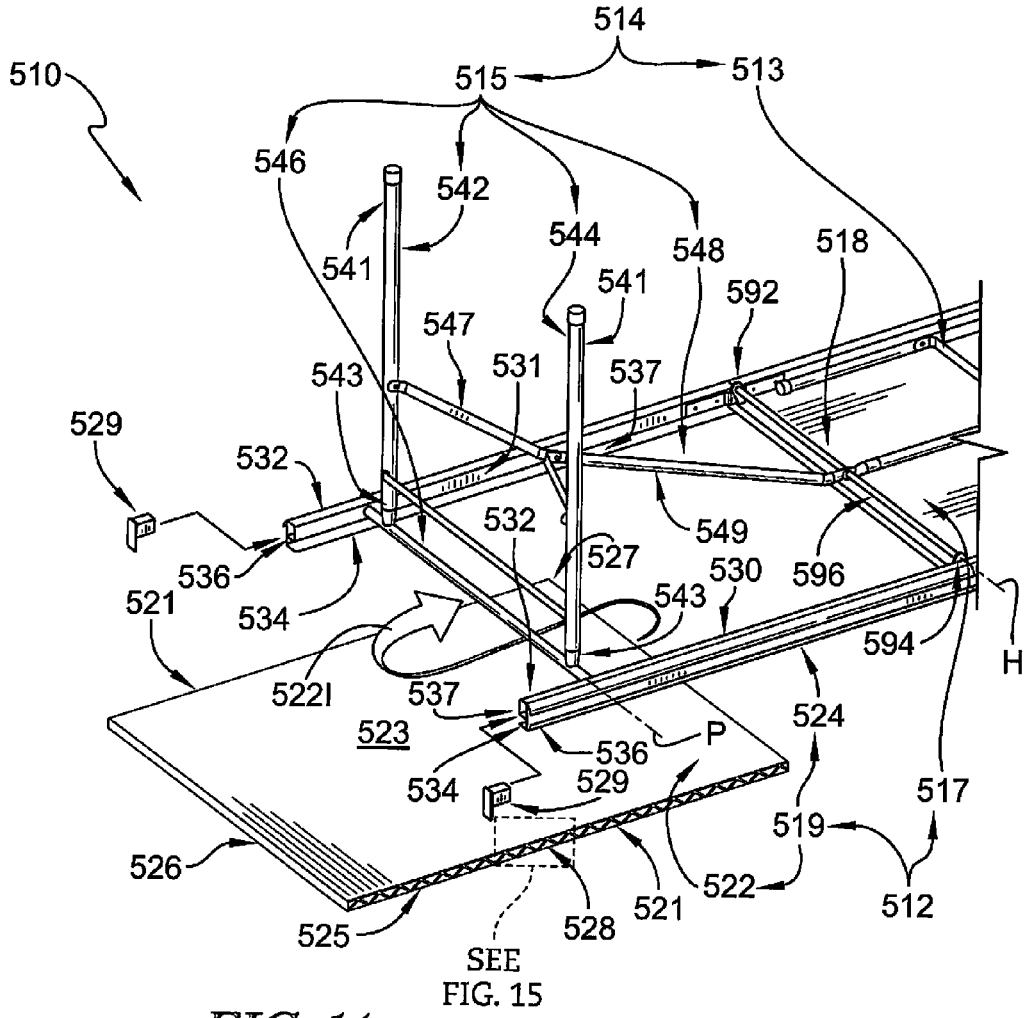
FIG. 14 is a partial bottom view of another embodiment of a folding table in accordance with the present disclosure showing that the folding table includes a table top having a right-side section and a left-side section connected to the right-side section by a hinge unit and a table top elevator configured to support the table top above a ground level and suggesting that each table top section includes a frame and a panel that slides into engagement with the frame to form the table top section.

A second embodiment of a folding table 510 in accordance with the present disclosure is shown in FIG. 14. Folding table 510 includes a table top 512 and a table top elevator 514 coupled to table top 512 for supporting table top 512 above a ground level. Table top 512 includes a right-side section 517 and a left-side section 519 coupled to right-side section 517 by a hinge unit 518 for rotation about a hinge axis H between an expanded-use position and a collapsed-storage position where right-side section 517 and left-side section 519 are folded toward one another about hinge axis H.

Figure 15:
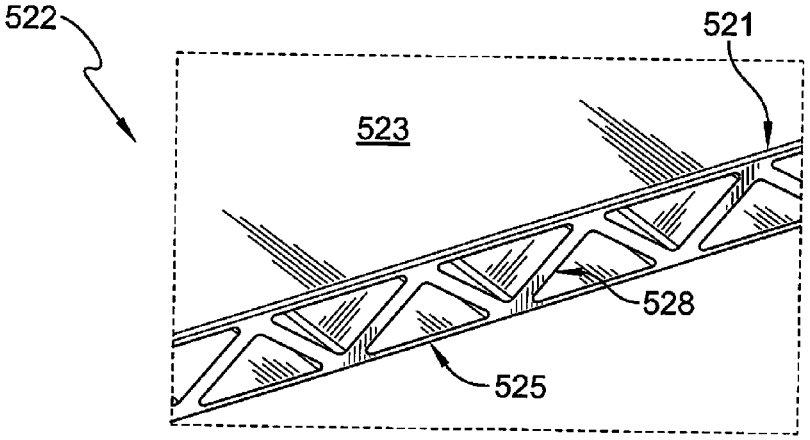
FIG. 15 is an enlarged view of the panel of FIG. 14 showing that the panel is formed to include an internal lattice structure to provide side-to-side support for the panel and suggesting that the panel is formed by extrusion.

Right-side section 517 and a left-side section 519 of table top 512 each include a panel 522 for supporting items placed on table top 512 and a frame 524 for supporting panels 522 on table top elevator 514 as shown in FIG. 14. Each panel 522 includes an under side sheet 523, a top side sheet 525 spaced apart from under side sheet 523, and a plurality of lattice members 528 extending between under side sheet 523 and top side sheet 525 to couple under side sheet 523 to top side sheet 525 as shown in FIG. 15. Lattice members 528 extend between lateral edges 521 of panel 522 to provide side-to-side support across panels 522.

In the illustrative embodiment, lattice members 528 are angled with respect to under side sheet 523 and top side sheet 525 as shown in FIG. 15. Lattice members 528 are patterned to provide strength and rigidity to panel 522. The pattern of lattice members 528 extends between an outer edge 526 of panel 522 and an inner edge 527. In some examples, each panel 522 is formed by an extrusion process as a unitary structure.

Frame 524 includes a first frame rail 530 and a second frame rail 531 spaced apart from first frame rail 530 and parallel to first frame rail 530 as shown in FIG. 14. First and second frame rails 530, 531 each include a frame tube 532, an upper wall 534 spaced apart from frame tube 532, and an outer wall 536 connecting frame tube 532 with upper wall 534. Frame tube 532 and upper wall 534 at least partially define a panel-receiving slot 537 configured to receive lateral edges 521 of panels 522. In the illustrative embodiment, frame tube 532 is rectangular in cross-section. However, frame tube 532 may have different shaped cross-sections as shown, for example, in FIGS. 8-11. In some examples, first and second frame rails 530, 531 are formed by extrusion processes as unitary structures.

Panel-receiving slot 537 is configured to receive lateral edges 521 of panels 522 and allow panels 522 to slide relative to frame 524 as suggested by arrow 5221 in FIG. 14. End caps 529 couple with and cover distal ends of first and second frame rails 530, 531 to maintain engagement of panel 522 and frame 524. A user may disengage panels 522 from frames 524 by removing end caps 529 from first and second frame rails 530, 531 and sliding panel 522 out of panel-receiving slots 537.

Table top elevator 514 includes a right-side leg unit 513 coupled to right-side section 517 of table top 512 and a left-side leg unit 515 coupled to left-side section 519 as shown in FIG. 14. Right-side leg unit 513 and left-side leg unit 515 each include a first leg 542 and a second leg 544. In some embodiments, first leg 542 and second leg 544 are formed from metal tubes. First leg 542 and second leg 544 each include a lower end 541 and an upper end 543. Right-side leg unit 513 and left-side leg unit 515 each further include a pivot bar 546 coupled between first and second frame rails 530, 531 and pivotable about a pivot axis P. Upper ends 543 of first and second legs 542, 544 are coupled to pivot bar 546 for rotation about pivot axis P and moveable between an opened position extending away from table top 512 and a closed position extending along table top 512.

Hinge unit 518 includes a first hinge 592 coupled between right-side and left-side sections 517, 519, a second hinge 594 coupled between right-side and left-side sections 517, 519, and a cross bar 596 coupled between first and second hinges 592, 594 as shown in FIG. 14. Hinge unit 518 allows pivoting movement of right-side and left-side sections 517, 519 about hinge axis H. Right-side leg unit 513 and left-side leg unit 515 each further include a support-mover linkage 548 for guiding motion of first and second legs 542, 544. Support-mover linkages 548 each include first linkage bars 547 coupled to first and second legs 542, 544 and a second linkage bar 549 coupled between first linkage bars 547 and cross bar 596 of hinge unit 518.

First linkage bars 547 are pivotable relative to first and second legs 542, 544, and second linkage bar 549 is pivotable with respect to first linkage bars 547 and cross bar 596 as suggested in FIG. 14. In some examples, a sleeve or collar is coupled to second linkage bar 549 to slide along second linkage bar 549 and is movable between a locked position covering a joint between first and second linkage bars 547, 549 to hold right-side and left-side leg units 513, 515 in the opened position and an unlocked position away from the joint between first and second linkage bars 547, 549 to allow pivoting movement of right-side and left-side leg units 513, 515.

In some embodiments, panels 22, 222, 322, 422, and 522 may be formed by various processes. For example, panels 22, 222, 322, 422, and 522 may be formed by one of blow-molding, extruding, injection molding, or laminating. In some embodiments, panels 22, 222, 322, 422, and 522 may be formed of various materials such as metal, plastic, wood, or combinations thereof.

In illustrative embodiments, the folding tables 10, 510 may be modular to work with panels 22, 522 of various designs. For example, the top sides 25, 525 and/or bottom sides 23, 523 of panels 22, 522 may be flat or formed to include patterns or recesses. In some embodiments, the panels may be inserted into the frame rails 30, 31, 530, 531 in various orientations. For example, the panels 22, 522 may be inserted such that the top side of the panels faces away from the leg units 13, 15, 513, 515 or faces toward the leg units 13, 15, 513, 515. In some embodiments, graphics may be incorporated into the panels 22, 522.

In illustrative embodiments, the extruded frame provides a track for the table top panels to slide into. Separate blow molded table top panels slide into the extruded frame. A bump on the panel holds the panel in the frame.

In illustrative embodiments, an extruded table top panel slides into an extruded frame. End caps couple with the extruded frame to hold the panel on the frame and finish off the frame ends.

The invention claimed is:

1. A table comprising a table top including a first section and a second section, a hinge unit coupling the first section of the table top to the second section, the hinge unit configured to allow rotation of the first section of the table top relative to the second section between an expanded-use position and a collapsed-storage position, and a table top elevator configured to support the table top above a ground level, the table top elevator including a first leg unit coupled to the first section of the table top and a second leg unit coupled to the second section of the table top, wherein each table top section includes a panel and a frame, the frame including two spaced apart and parallel frame rails coupled to the hinge unit and one of the first or second leg units, the frame rails formed to include mounting means for receiving a portion of the table top panels to hold the table top panels in place relative to the table top elevator so that the panels form a planar top surface of the table top in the expanded-use position during use of the table.

2. The table of claim 1, wherein each frame rail includes a frame tube, an upper wall spaced apart from the frame tube, and an outer wall that interconnects the frame tube with the upper wall, and wherein the frame tube and the upper wall at least partially define a panel-receiving slot configured to receive a lateral edge of one of the panels.

3. The table of claim 2, wherein each panel includes a body having the lateral edges and a panel retainer coupled to the body on at least one of the lateral edges, and wherein at least one of the frame rails includes a retainer slot that receives the panel retainer to maintain position of the panel with respect to the frame rail.

4. The table of claim 3, wherein each panel further includes an end cap coupled to the body and arranged to engage with distal ends of the frame rails when the panel is received in the frame.

5. The table of claim 2, wherein the panels are each formed to include a recess in a top side of the panel along the lateral edges configured to receive the upper wall of the frame rail to allow the upper wall to be planar with the top side of the panel when the panel is received in the frame.

6. The table of claim 5, wherein the frame tube has a rectangular outer profile.

7. The table of claim 2, wherein a portion of the frame tube is concave and the upper wall has a concave profile continuous with the concave portion of the frame tube.

8. The table of claim 7, wherein the panels are each formed to include a recess in the lateral edge configured to receive the upper wall and allow the panel and frame rail to cooperate to define a continuous concave edge profile along the table top section.

9. The table of claim 2, wherein a portion of the frame tube is convex and the upper wall has a convex profile continuous with the convex portion of the frame tube.

10. The table of claim 9, wherein the panels are each formed to include a recess in the lateral edge configured to receive the upper wall and allow the panel and frame rail to cooperate to define a continuous convex edge profile along the table top section.

11. The table of claim 1, wherein the frame rails each include a first wall extending outward and upward from the frame rail and a second wall spaced apart from the first wall and extending outward and downward from the frame rail to at least partially define an accessory slot configured to receive accessories for attachment to the table top.

12. The table of claim 1, wherein a top side of each panel has a first set of features and an under side of each panel has a second set of features different from the first set of features, wherein the panels are each formed to include a recess along the lateral edges configured to receive the upper wall of the frame rail to allow the upper wall to be planar with the top side or under side of the panel when the panel is received in the frame.

13. The table of claim 12, wherein each panel is configured to be received in the frame with either the top side or the under side facing upward at the selection of a user of the table when the table is in the expanded-use position.

14. A table comprising a table top including a first section and a second section, a hinge unit coupling the first section of the table top to the second section and configured to allow rotation of the first section of the table top relative to the second section between an expanded-use position and a collapsed-storage position, and a table top elevator configured to support the table top and including a first leg unit coupled to the first section of the table top and a second leg unit coupled to the second section of the table top, wherein each table top section includes a panel and a frame, the frame including two fixedly spaced apart parallel frame rails coupled to the hinge unit and one of the first or second leg units, the frame rails formed to include a panel receiving slot configured to slideably receive the lateral edges of one of the panels between the fixedly spaced apart parallel frame rails to removably mount the said one of panels to the table top elevator.

15. The table of claim 14, wherein each panel includes a top side sheet, an under side sheet spaced apart from the top side, and a plurality of lattice members extending between the top side sheet and under side sheet to couple the top side sheet to the under side sheet.

16. The table of claim 15, wherein the panels are of extruded construction and the lattice members extend in a lateral direction across the panels between the lateral edges, and wherein the lattice members are configured to provide side-to-side lateral support of the top side sheets and under side sheets of the panels.

17. The table of claim 14, further comprising end caps configured to engage with distal ends of the frame rails to hold the panel in the frame.

18. The table of claim 14, wherein a top side of each panel has a first set of features and an under side of each panel has a second set of features different from the first set of features.

19. The table of claim 18, wherein each panel is configured to be received in the frame with either the top side or the under side facing upward at the selection of a user of the table when the table is in the expanded-use position, wherein the panels are each formed to include a recess along the lateral edges configured to receive the upper wall of the frame rail to allow the upper wall to be planar with the top side or under side of the panel when the panel is received in the frame.

20. A table comprising a table top having a length and a width and including a first section and a second section, a hinge unit coupling the first section of the table top to the second section and for rotation of the first section of the table top relative to the second section between an expanded-use position and a collapsed-storage position, and a table top elevator including a first leg unit coupled to the first section of the table top and a second leg unit coupled to the second section of the table top, the first and second leg units each configured to pivot relative to the table top sections between a closed position extending along the table top to allow folding of the table top to the collapsed-storage position and an opened position extending away from the table top to support the table top in the expanded-use position above a ground level, wherein each table top section includes a panel and a frame, the frame including two spaced apart and parallel frame rails extending along the table top length and coupled to the hinge unit and one of the first or second leg units, the frame rails formed to include a panel-receiving slot configured to slideably receive one of the panels to removably mount said one of the panels to the table top elevator.

21. The table of claim 20, wherein each panel is mounted on the frame by sliding each panel into the two spaced apart frame rails.

22. The table of claim 21, wherein each panel is removable from the frame by sliding each panel with respect to the frame rails.

* * * * *